US005628265A

United States Patent [19]

Azima et al.

[11] Patent Number: 5,628,265

[45] Date of Patent: May 13, 1997

[54] SAIL BOATS

[75] Inventors: Farad Azima, Marlow; Kieron Dunk, Fenstanton, both of Great Britain

[73] Assignee: Mission Yachts PLC, London, United Kingdom

[21] Appl. No.: 550,471

[22] Filed: Oct. 30, 1995

[30] Foreign Application Priority Data

| | | | |
|---|---|---|---|
| Nov. 1, 1994 | [GB] | United Kingdom | 9421910 |
| Aug. 7, 1995 | [GB] | United Kingdom | 9516131 |

[51] Int. Cl.[6] ..... B63B 29/00

[52] U.S. Cl. ..... 114/39.1; 114/361

[58] Field of Search ..... 114/39.1, 361, 114/343

[56] References Cited

U.S. PATENT DOCUMENTS

| | | | |
|---|---|---|---|
| 3,195,549 | 7/1965 | Stevens | 114/361 |
| 3,371,672 | 3/1968 | Hale et al. . | |
| 3,734,047 | 5/1973 | Burton | 114/361 |
| 3,797,436 | 3/1974 | Moore | 114/361 |
| 4,664,050 | 5/1987 | Clauser . | |
| 4,742,795 | 5/1988 | DePrey et al. | 114/343 |
| 4,951,594 | 8/1990 | Feikema | 114/361 |
| 5,052,326 | 10/1991 | Wiggen et al. | 114/343 |
| 5,303,667 | 4/1994 | Zirkelbach et al. . | |

FOREIGN PATENT DOCUMENTS

| | | | |
|---|---|---|---|
| 1242613 | 10/1988 | Canada . | |
| 2104838 | 8/1972 | Germany . | |
| 580246 | 1/1946 | United Kingdom . | |
| WO9406676 | 3/1994 | WIPO | 114/361 |

*Primary Examiner*—Sherman Basinger

*Attorney, Agent, or Firm*—Gary M. Nath; Richard E. Campbell; Nath & Associates

[57] ABSTRACT

In a sail boat having a hull, an upstanding mast in the hull, a boom articulated on the mast, a sail supported on the mast and controlled by the boom, a crew cockpit disposed below the boom, the cockpit having a front, sides and a rear, and a hoop-like structure straddling the cockpit transversely of the boat in the vicinity of and below the boom to define a safe area within the cockpit into which the boom is positively prevented from encroaching; screen structure is provided which has a front portion arranged to shield the cockpit front and side portions which shield the cockpit sides. A track along which the screen structure is slidable longitudinally of the boat is included. The screen structure is arranged such that in its rearward position the side portions of the screen structure seal against the hoop-like structure.

8 Claims, 7 Drawing Sheets

SAIL BOATS

DESCRIPTION

The invention relates to sail boats and more particularly, but not exclusively, to sail boats of the nature of ocean-going yachts.

It is among the objects of the invention to provide means for improving the safety and/or the comfort of the crew and/or passengers on such a craft.

It is also among the objects of the invention to provide means for improving the security and/or general tidiness of sail craft when laid up or when at anchor.

From one aspect the invention provides a sail boat comprising a hull, an upstanding mast in the hull, a boom articulated on the mast, a sail supported on the mast and controlled by the boom, a crew cockpit disposed below the boom, the cockpit having a front, sides and a rear, and a hoop-like structure straddling the cockpit transversely of the boat in the vicinity of and below the boom to define a safe area within the cockpit into which the boom is positively prevented from encroaching, the improvement comprising a screen structure having a front portion arranged to shield the cockpit front, and side portions to shield the cockpit sides, and comprising track means along which the screen structure is slidable longitudinally of the boat the arrangement being such that in its rearward position the side portions of the screen structure seal against the hoop-like structure.

According to another aspect the invention provides a sail boat of the kind having a mast supporting a sail controlled by a boom articulated on the mast and a crew or passenger cockpit disposed below the boom, comprising a hoop-like structure straddling the cockpit transversely of the boat in the vicinity of and below the boom to define a safe area within the cockpit into which the boom is positively prevented from encroaching, and a folding hood supported by the hoop-like structure and arranged in an inoperative condition to be stowed adjacent to or in the hoop-like structure and in an erected condition at least partly to cover the cockpit.

The hoop-like structure may comprise a generally horizontal portion extending over the cockpit, preferably at or above normal head height and on which is mounted a track along which a car is slidable, which car is adapted to be connected to the boom by a sheet or line to control the movement of the boom. By this arrangement the sheet or line can be relatively short since the car is mounted at a high level, preferably above head level, and thus close to the boom so that control of the boom can be more precise.

The hoop-like structure may be formed hollow or recessed and the various sheets or lines controlling the operation of the sail boat may be ducted along or through the hoop-like structure to emerge at a convenient position or positions at or near the cockpit where the sheets of lines are attached in generally conventional manner to winches or the like control means.

Preferably the sail boat comprises a screen structure arranged to shield at least the cockpit front. Preferably the screen structure is formed with side portions to shield the sides of the cockpit. Preferably the screen structure is longitudinally slidable and is arranged in its rearward or closed position to seal against the hoop-like structure.

Preferably the folding hood is adapted to seal against the screen structure when the screen structure is in its rearward position. The folding hood may comprise a frame having a generally U-shaped member, the free ends of the limbs of which are pivoted on or adjacent to the hoop-like structure and the limbs of which are extendable to tension the flexible material of the folding hood. An over centre mechanism may be provided to lock the U-shaped member in its extended position. The over centre mechanism may resemble that of a pram hood. The U-shaped member may carry a secondary U-shaped member, the free ends of which are pivoted on the U-shaped member and which is moveable from an inoperative position in which it is disposed against the U-shaped member to an erected position when the folding hood is tensioned in which the secondary U-shaped member projects from the U-shaped member to increase the available hood-room in the cockpit.

In one preferred arrangement a pram-like foldable flexible cover is mounted at the rear of the cockpit and is arranged when erected to cover the rear part of the cockpit and to seal against the hoop-like structure whereby the cockpit area can be wholly enclosed.

Preferably the hoop-like structure is arranged substantially at the free end of the said boom so that the length of the boom control sheet or line is minimised and so that control of the boom is optimised. By mounting the car on a track on the hoop-like structure it is possible to extend the length of the track which again has a beneficial effect on the control of the boom. The hoop-like structure may be provided with a central lockable stowage position for the boom when the vessel is laid up or at anchor.

Various instruments and controls and other accessories such as light fittings, e.g. navigation lamps, may be mounted on the hoop-like structure with the benefit of being disposed at a relatively high level. A radar and/or satellite navigation antenna may be mounted on the structure.

The hoop-like structure may act as a grab rail or may have an integral or attached grab rail or rails for use by the crew and/or passengers.

The invention is diagrammatically illustrated by way of example in the accompanying drawings in which.

Figure 1:
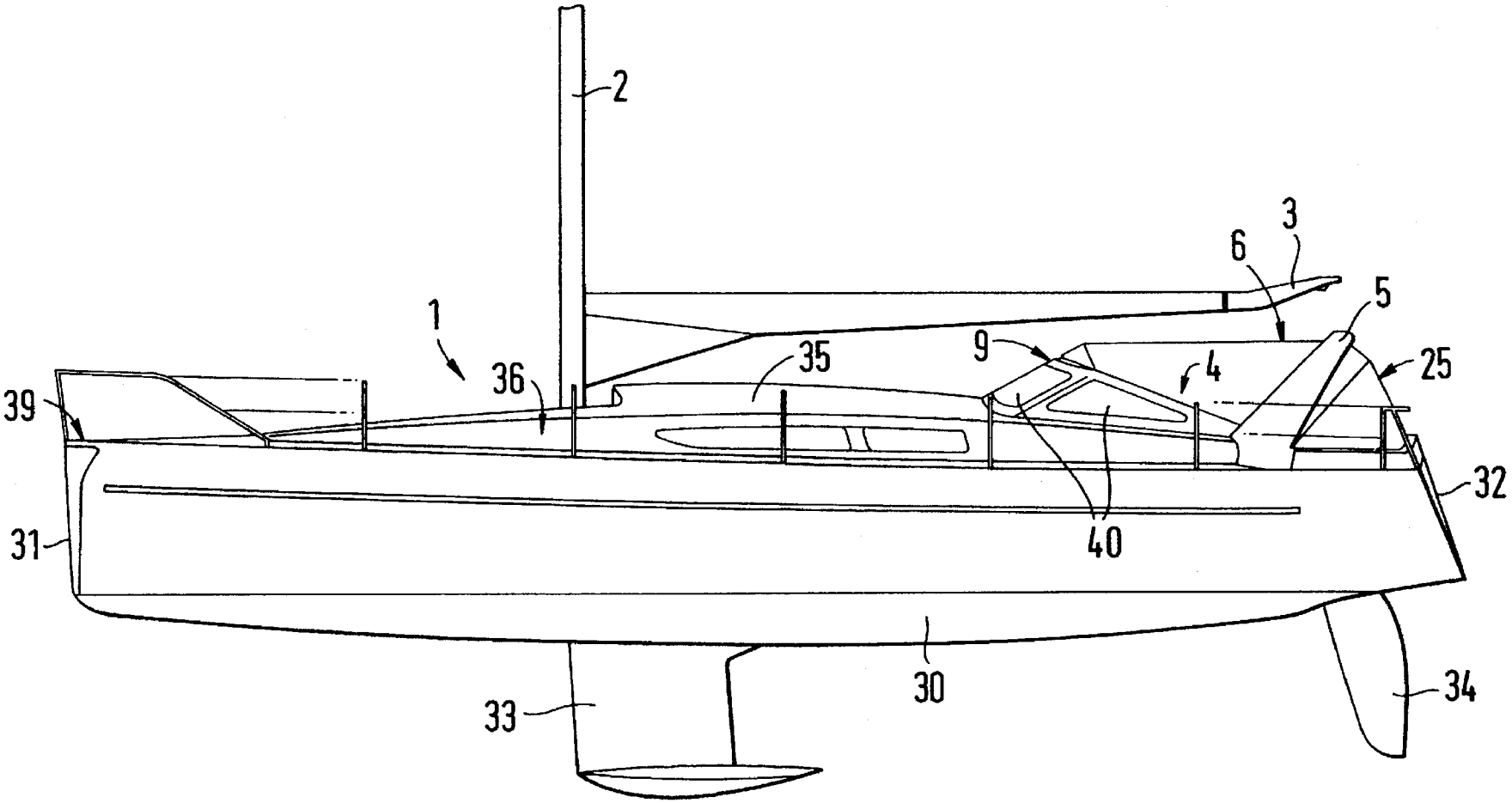
FIG. 1 is a side view of a sailing yacht.
Figure 2:
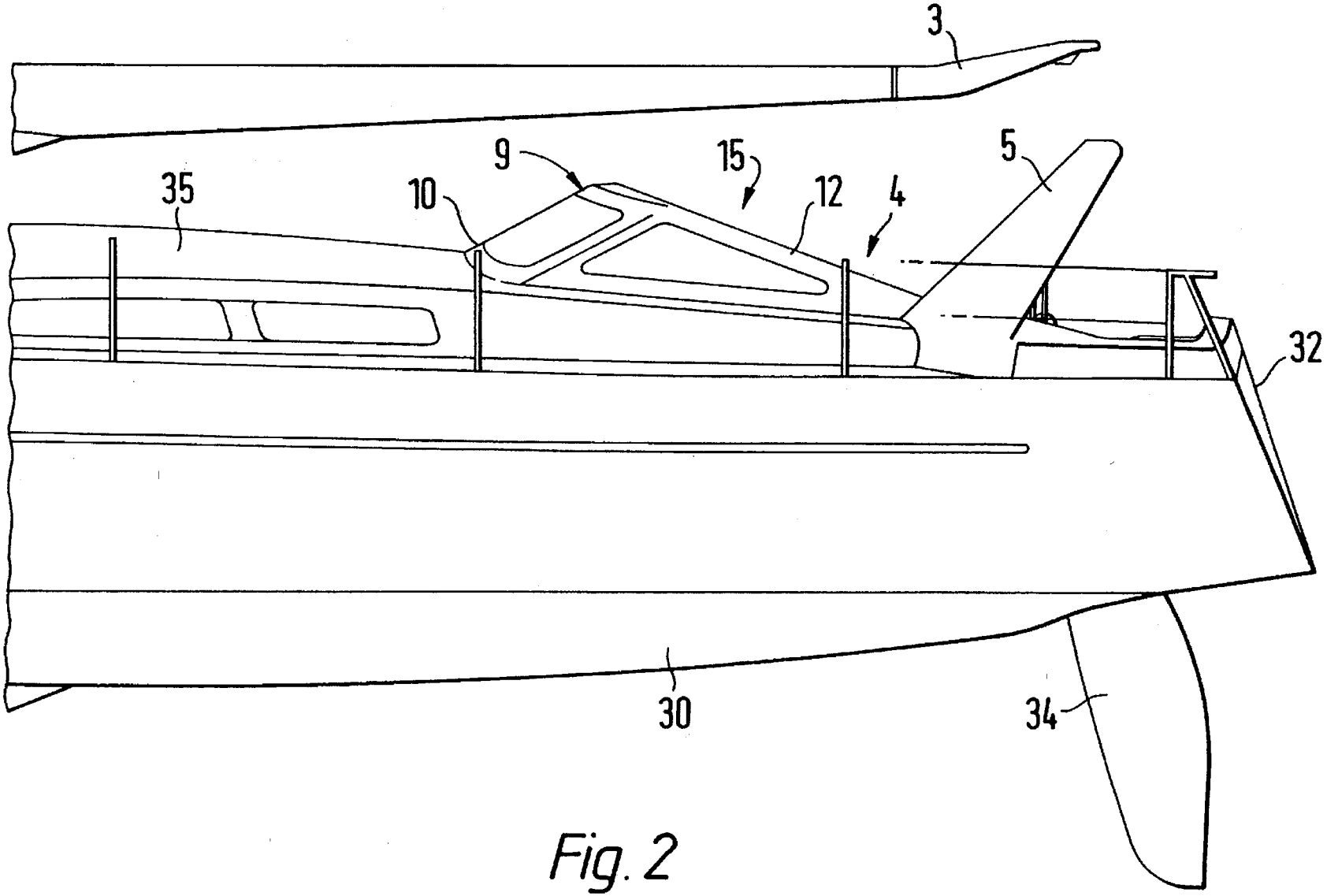
FIGS. 2, 3 and 4 are scrap views of the stern part of the sailing vessel of FIG. 1 in different operating conditions.

In the drawings there is shown an ocean going cruising sail boat or yacht 1 having a hull 30, with a bow 31 at one end and a stern 32 at the other end, a deck 39, a superstructure 36 and a mast 2 e.g. of carbon fibre composite, on which is articulated a boom 3 for controlling one or more sails (not shown). In generally conventional fashion the hull is formed with a downwardly depending keel 33, a steering rudder 34 and a motor driven propeller (not shown) e.g. for use in manoeuvring the vessel at low speed in harbour and other confined spaces. In normal fashion the mast 2 is supported by stays (not shown) including a fore-stay, shrouds i.e. side-stays, and by back-stays which are secured at their upper ends to the mast 3 adjacent to its top (not shown), and at their lower ends to the hull.

Figure 3:
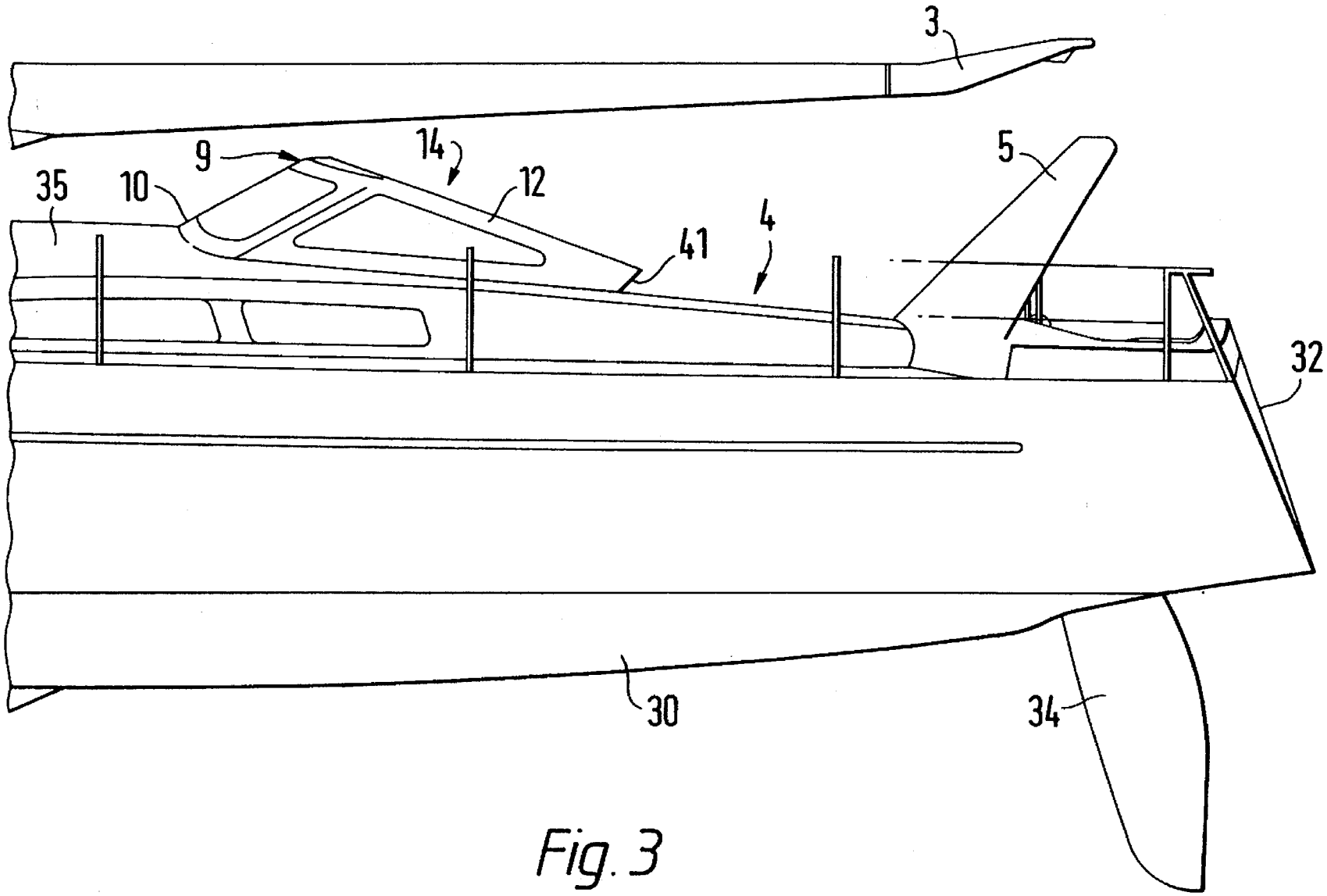

The superstructure 36 of the yacht comprises a cabin 35 and, near to its stern 14, a cockpit area 4 for use by the crew and/or by passengers. A generally hoop-like structure 5 straddles the rear of the cockpit area 4 to provide a safety cage preventing incursion of the boom 3 into the cockpit area. A sliding screen structure 9 having a front portion 10 and side portions 12 having rear ends 41, all of which are formed with windows 40, is mounted on the superstructure 36 to be movable longitudinally of the vessel along track means 51 from a rearward position 15 as shown in FIGS. 1, 2, 4 and 6, in which it surrounds the front and sides of the cockpit area and in which the rear ends 41 of the side portions 12 abut the structure 5, to a forward position 14, as shown in FIGS. 3 and 5, in which the sliding screen structure 9 is disposed largely or wholly in front of the cockpit area and out of contact with the hoop-like structure 5.

Figure 7:
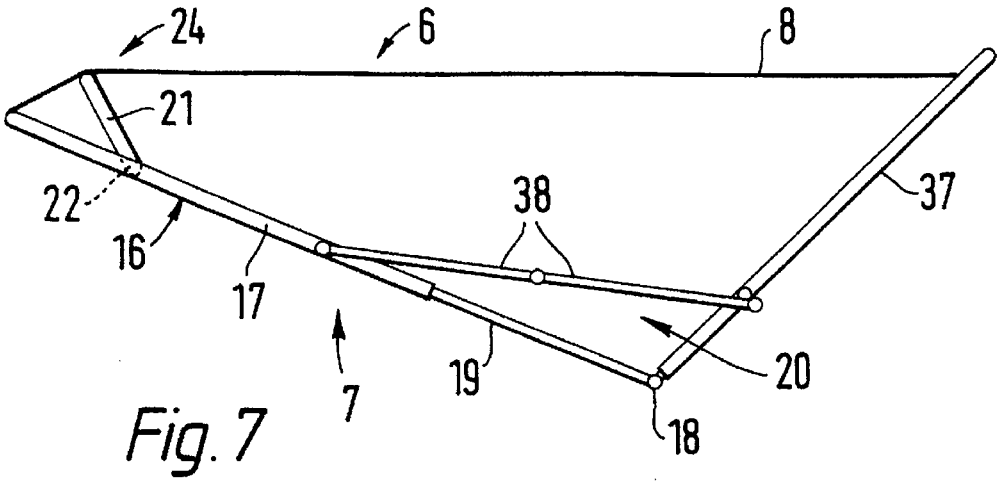
FIGS. 7 to 9 are respective views of a folding hood for use with the sailing yacht of FIG. 1 and showing the hood in various stages of erection.
Figure 8:
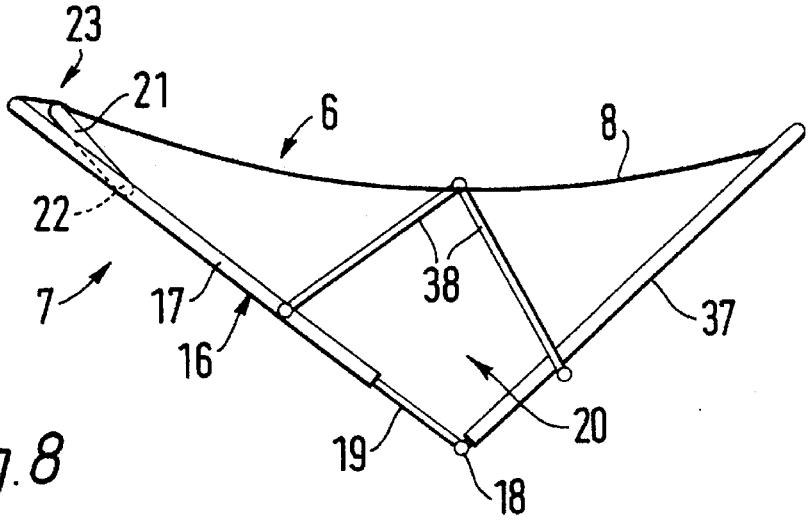
Figure 9:
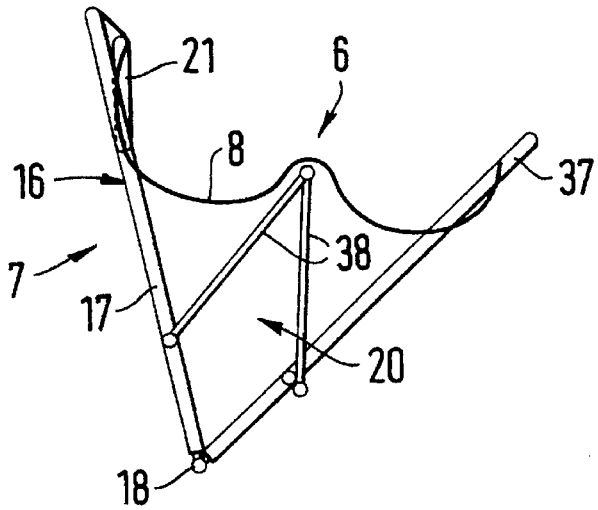

As is shown more particularly in FIGS. 7 to 9, a first folding hood 6 is mounted on or in the structure 5 and comprises a frame 7 having a main U-shaped member 16 having a pair of limbs 17, the free ends of which are pivoted on or adjacent to the structure 5 on a generally U-shaped fixture 37 which is secured to the structure 5. The limbs 17 have telescopically extendable portions 19. An over-centre mechanism 20, comprising a pair of pivotally interconnected arms 38 the free ends of which are pivotally connected respectively to the limbs 17 and the fixture 37, is arranged so that when the member 16 is pivoted away from a stowed position, (not shown) in which it is disposed against the fixture 37, through the intermediate positions shown in FIGS. 8 and 9, to the fully erected position shown in FIG. 7 in which the limbs 17 are forced to extend to tension a flexible hood cover 8 the ends of which are held respectively by the member 16 and the fixture 37. A secondary U-shaped member 21 is pivotally mounted by its free ends 22 on the member 16 and is connected to the flexible cover 8 so that when the cover is tensioned the secondary member moves away from its stowed position and through the partly erected positions shown in FIGS. 8 and 9 into the erected position as shown in FIG. 7, in which it projects away and upwardly from the member 16 to increase the head-room available in the cockpit under the folding hood.

Figure 4:
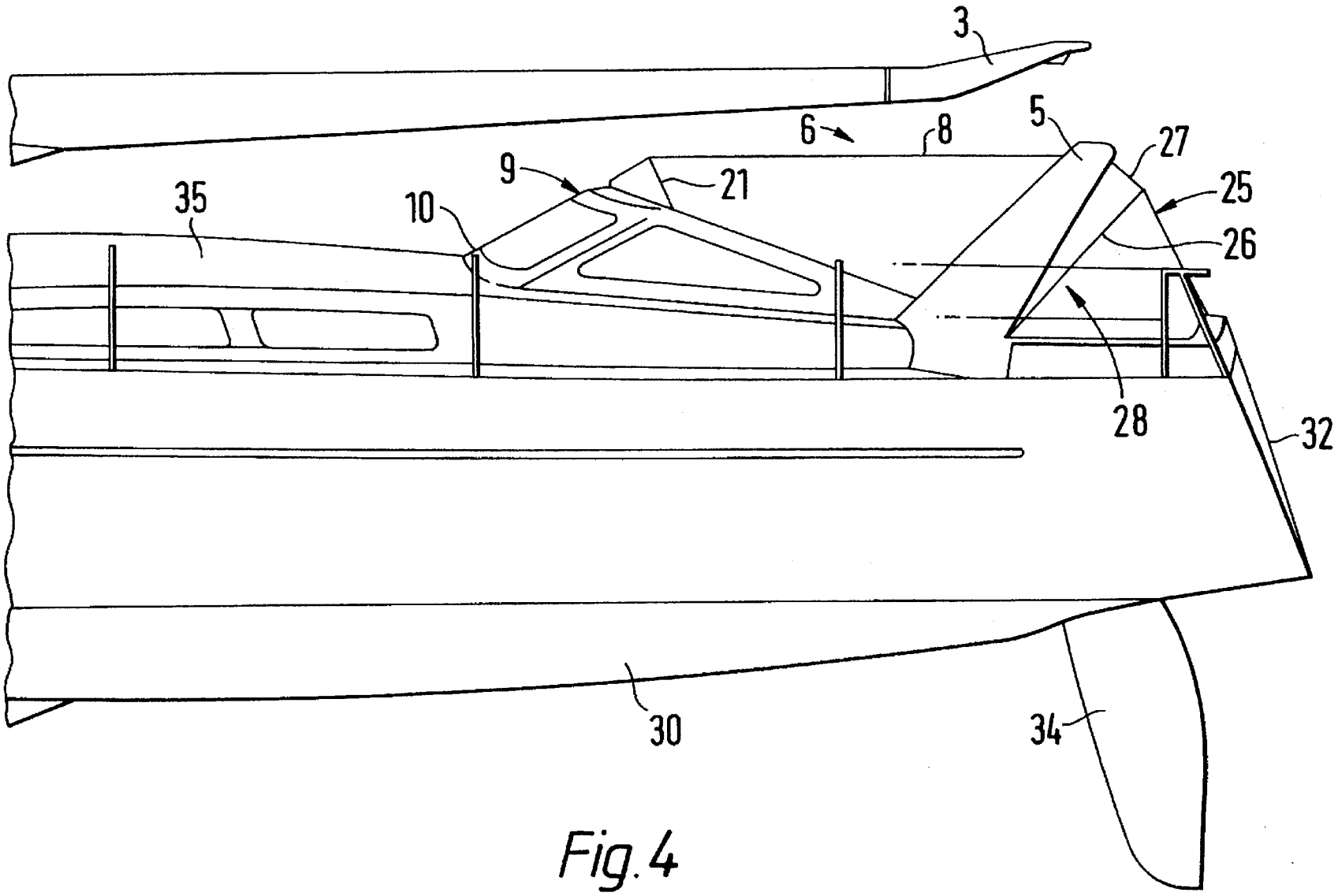
Figure 5:
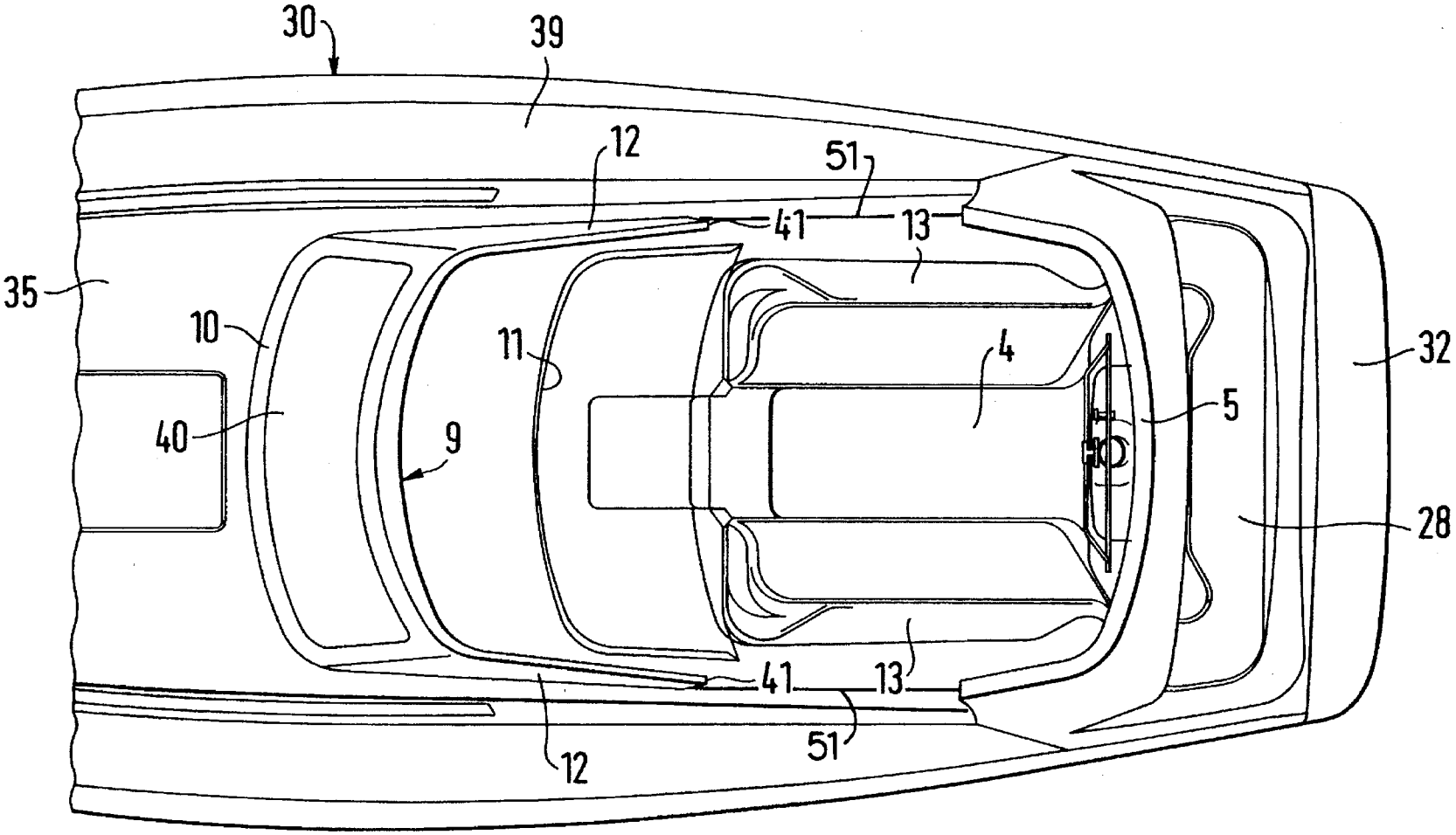
FIGS. 5 and 6 are scrap plan views corresponding to FIGS. 3 and 4 respectively.
Figure 6:
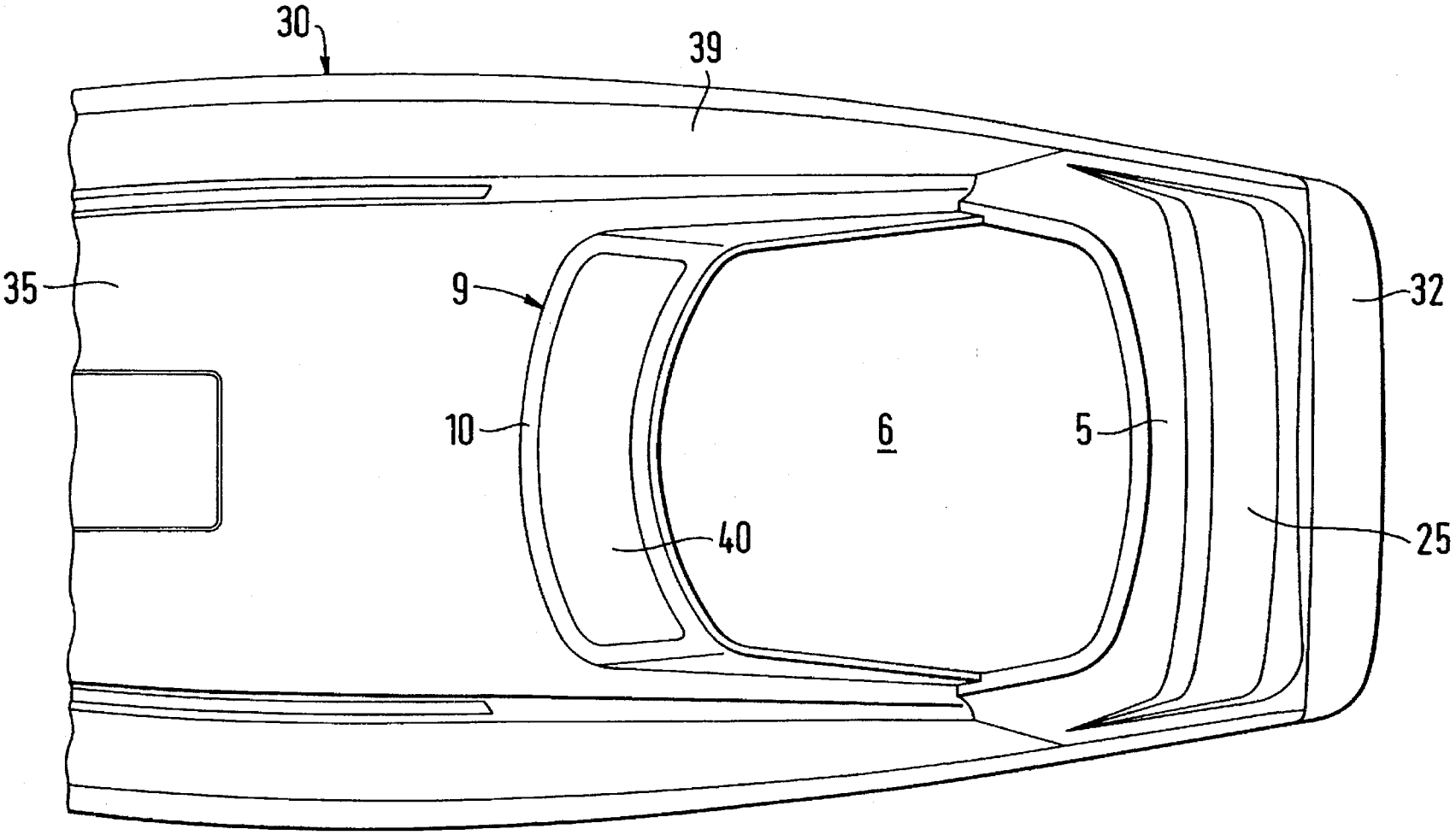

A second folding hood 25 is mounted on the stern of the vessel behind the structure 5 and comprises a pivoting frame 26 and a flexible cover 27 resembling an infant's perambulator hood and which can be moved from a stowed position in which it is substantially flush with the deck 39 of the vessel to an erect position as shown in FIGS. 1, 4 and 6 in which it abuts against the structure 5 to enclose the rear 28 of the cockpit.

As an alternative to the use of the folding hood 6, a rigid roof panel may be provided and which can be secured detachably to the screen structure 9 and the structure 5 when the structure 9 is in its rearward position.

Thus the cockpit can be wholly enclosed to provide security and protection both when the boat is laid-up and when the crew is sleeping on board. In this connection the folding hoods may be made from, or reinforced with, a tough material e.g. an aramid fibre such as that known under the Trade Name "KEVLAR" to increase the security of the hood. The enclosure of the cockpit, also provides protection in foul weather, shelter from spray and the like and can assist in preventing cockpit flooding. The cockpit enclosure also provides a sun shade.

The invention thus provides significant improvements over the state of the art.

We claim:

1. In a sail boat comprising a hull, an upstanding mast in the hull, a boom articulated on the mast, a crew cockpit disposed below the boom, the cockpit having a front, sides and a rear, and a hoop-like structure straddling the cockpit transversely of the boat in the vicinity of and below the boom to define a safe area within the cockpit into which the boom is positively prevented from encroaching, the improvement comprising a screen structure having a front portion arranged to shield the cockpit front, and side portions to shield the cockpit sides, and comprising track means along which the screen structure is slidable longitudinally of the boat the arrangement being such that in its rearward position the side portions of the screen structure seal against the hoop-like structure.

2. A sail boat according to claim 1, further comprising a folding hood having a frame and a cover of flexible material, the folding hood being adapted to be secured to the hoop-like structure and in an erected condition at least partly to cover the cockpit.

3. A sail boat according to claim 2, wherein the folding hood is adapted to seal against the screen structure when the screen structure is in its rearward position, to enclose at least a forward portion of the cockpit.

4. A sail boat according to claim 2, wherein the frame of the folding hood comprises a generally U-shaped member having a pair of limbs joined together by an intermediate portion, the free ends of the limbs being pivoted at the hoop-like structure and the limbs being extendable to tension the flexible cover of the folding hood.

5. A sail boat according to claim 4, wherein the limbs of the U-shaped member comprise telescopically extendable portions.

6. A sail boat according to claim 4, comprising an over centre mechanism on the folding hood frame to lock the U-shaped member in its extended position.

7. A sail boat according to claim 4, wherein the folding hood frame comprises a secondary U-shaped member, the free ends of which are pivoted on the U-shaped member and which is moveable from an inoperative position in which it is disposed against the U-shaped member to an erected position when the folding hood is tensioned in which the secondary U-shaped member projects upwardly from the U-shaped member to increase the available head-room in the cockpit.

8. A sail boat according to claim 2, comprising a second folding hood having frame and a cover of flexible material mounted at the rear of the cockpit and arranged when erected to cover a rear portion of the cockpit and to seal against the hoop-like structure.

* * * * *